US006276061B1

(12) United States Patent
Rozenkranc

(10) Patent No.: US 6,276,061 B1
(45) Date of Patent: Aug. 21, 2001

(54) MULTI-BLADE SHAVING APPARATUS

(76) Inventor: Menachem Rozenkranc, Dov Gruner St. 19, Ramat-Aviv, Tel Aviv 69498 (IL)

( * ) Notice: Subject to any disclaimer, the term of this patent is extended or adjusted under 35 U.S.C. 154(b) by 0 days.

(21) Appl. No.: 09/323,477

(22) Filed: Jun. 1, 1999

(30) Foreign Application Priority Data

Mar. 29, 1999 (IL) ..... 129210

(51) Int. Cl.[7] ..... B26B 21/14

(52) U.S. Cl. ..... 30/34.1; 30/50; 30/527; 30/346.5

(58) Field of Search ..... 30/50, 526, 527, 30/34.1, 346.5

(56) References Cited

U.S. PATENT DOCUMENTS 2,807,084 * 9/1957 Harman ..... 30/50
4,281,456 * 8/1981 Douglass et al. ..... 30/527
4,901,437 * 2/1990 Iten ..... 30/50
4,903,405 * 2/1990 Halvey ..... 30/527
4,970,784 * 11/1990 Althaus et al. ..... 30/527
5,167,069 * 12/1992 Quinn ..... 30/527
5,199,173 * 4/1993 Hegemann et al. ..... 30/531
5,533,263 * 7/1996 Gilder ..... 30/527
5,794,354 * 8/1998 Gilder ..... 30/527

* cited by examiner

*Primary Examiner*—Rinaldi I. Rada
*Assistant Examiner*—Kim Ngoc Tran
(74) *Attorney, Agent, or Firm*—Birch, Stewart, Kolasch & Birch, LLP

(57) ABSTRACT

A multi-blade shaving apparatus includes a handle holding a head body in which are located the shaving blades, advantageously three, extending parallel to each other. Furthermore, at least an additional blade (trim blade) is located at a suitable angle, preferably 60–120°, to the shaving blades. The shaving blades and the trim blade are preferably identical. Advantageously the apparatus is provided with a rotating device enabling different blades to be in contact with the skin.

6 Claims, 4 Drawing Sheets

MULTI-BLADE SHAVING APPARATUS

BACKGROUND OF THE INTENTION

1. Field of the Invention

The present invention relates to a multi-blade shaving apparatus.

2. Description of Related Art

The commercially available shaving apparatus are usually provided with more than one blade, i.e. with two or three (herein-after called "shaving blades"). The shaving utility is considerably improved by the use of a shaving apparatus comprising more than one blade. However, there is a drawback in using said apparatus for sideburns trimming or for similar purposes, e.g. a near nostril haircut. In this case it is difficult to determine which of the blades makes the final cut taking into consideration the pivoting action and the relative large area of the blade assembly which is in contact with the skin.

It has thus been desirable to design a multi-blade shaving apparatus which would be convenient for the regular shaving of the skin and would also be convenient for the use of side sideburns trimming and for similar purposes. Said multi-blade shaving apparatus should be easy for use and packaging, simple and not too expensive in its manufacture and enable a proper trimming of the sideburns and similar positions.

SUMMARY OF THE INVENTION

The present invention thus consists in a multi-blade shaving apparatus comprising a handle holding a head body, in which body are located the shaving blades. The shaving blades extend parallel to each other and in a suitable angle to said shaving blades is located at least an additional blade.

The handle, the shaving blades and the body, advantageously being a cast plastic body are substantially the same as those being used in the commercially available multi-blade shaving apparatus. The body should be slightly altered, i.e. lengthened so that the additional blade (herein called "trim blade") may be located therein.

The trim-blade is preferably an identical blade with the regular used shaving blades and it is preferably mounted within the body in the same slot as are the shaving blades.

The regular shaving blades usually have a spring action and this may also apply to the trim-blade.

The shaving apparatus according to the present invention is advantageously provided, as are the commercially available shaving apparatus, with rotating means enabling different blades to be in contact with the skin dependent on handle rotation.

When the shaving apparatus according to the present invention is used for regular shaving the trim-blade is not in contact with the skin. However, when sideburn trim or a similar action is required the handle is rotated substantially by 180°. The trim blade then comes in contact with the sideburns to be trimmed.

The trim blade is located at an adequate angle enabling a good trim, similar to the angle at which the shaving blades are located when the shaving is performed. The angle between the shaving blades and the trim blade is suitably 60–120°, advantageously 85–95°.

The shaving apparatus according to the present invention may take advantage of the pivoting action being eliminated, since the handle rests on the rest position stop when the shaving action pressure is applied at the reverse side of the body, e.g., at the trim blade side. The narrow area of contact between the trim blade and the skin thus enables a good trim.

Figure 1:
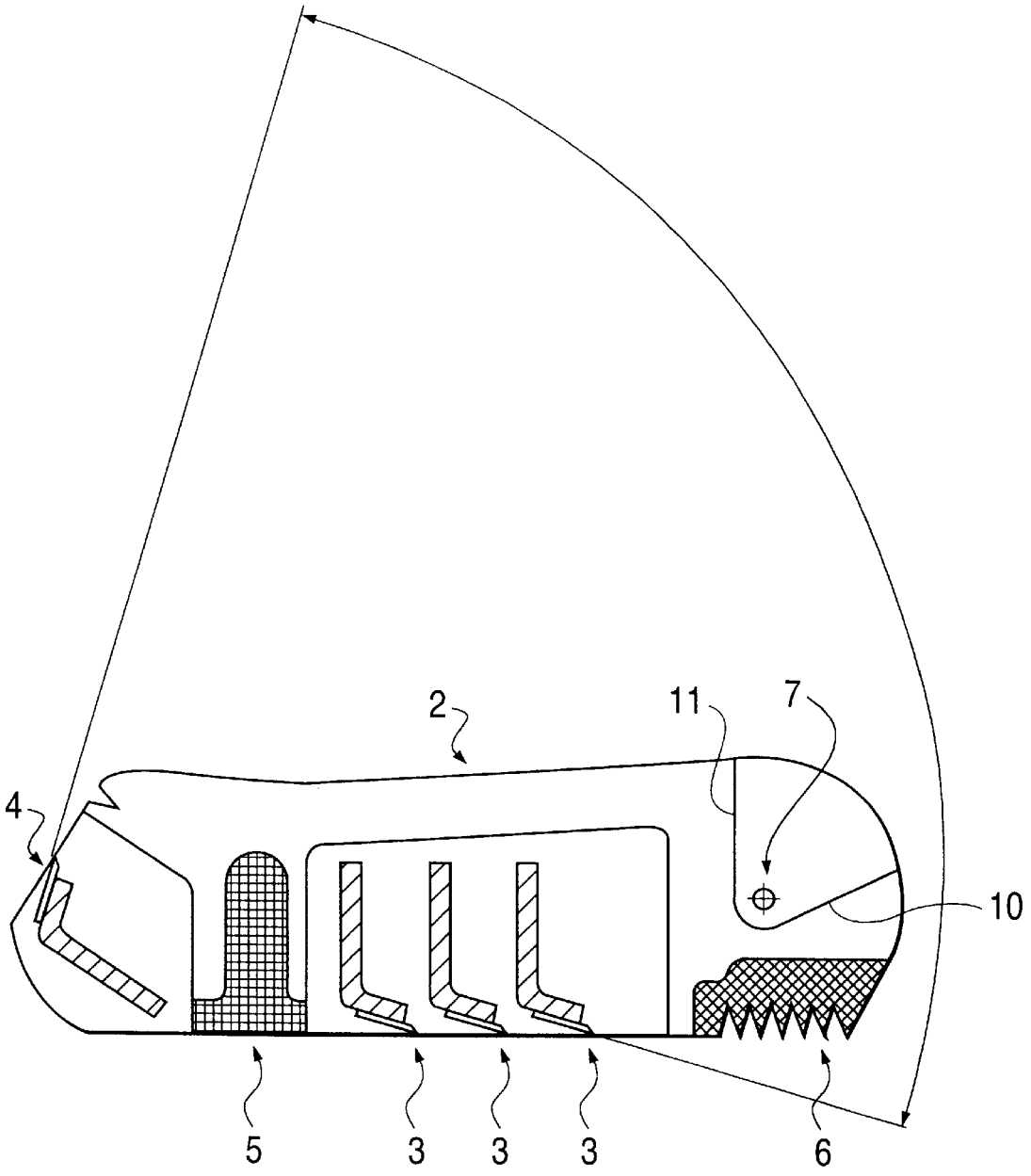
FIG. 1 shows a cross-section through a shaving apparatus (without handle) according to the present invention.
Figure 2A:
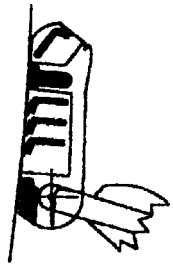
FIG. 2 shows a shaving apparatus according to the present invention schematically applied to the skin for regular shaving.
Figure 2:
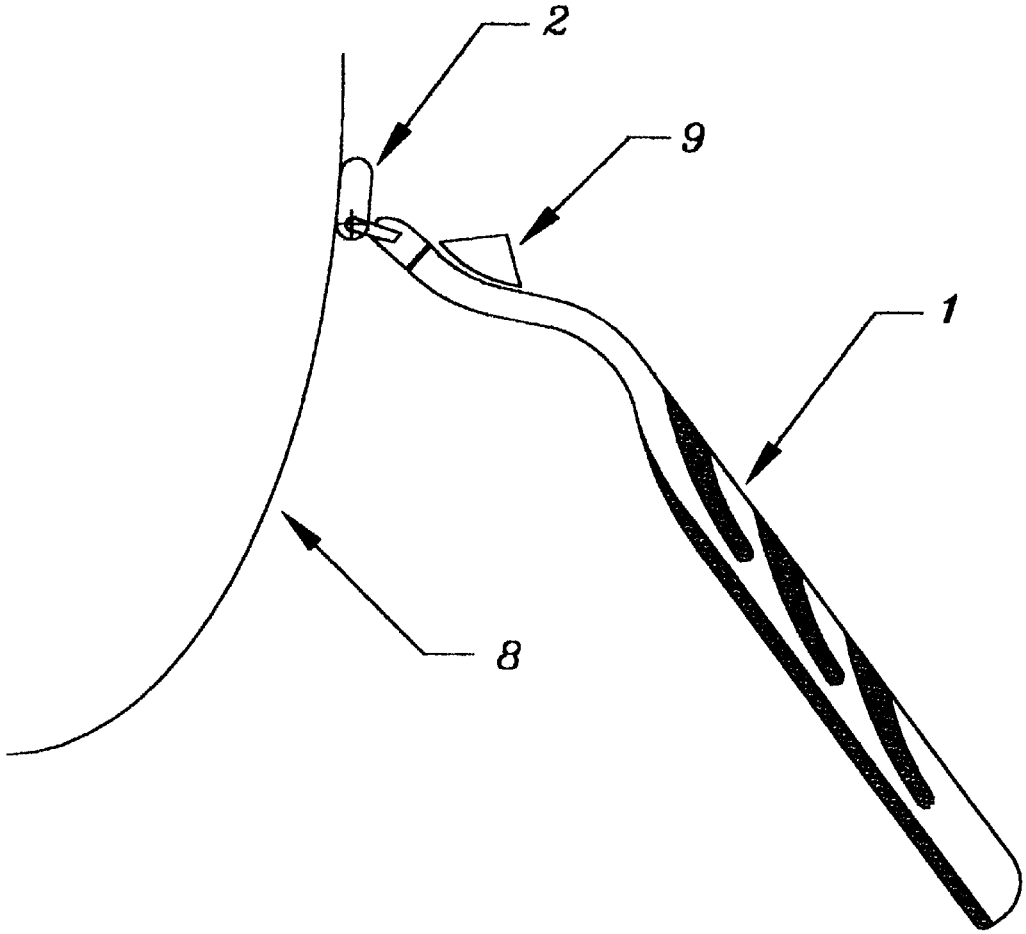
Figure 3A:
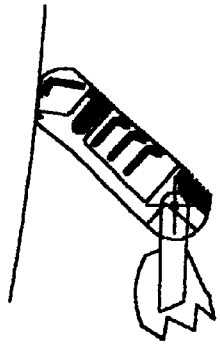
Figure 3:
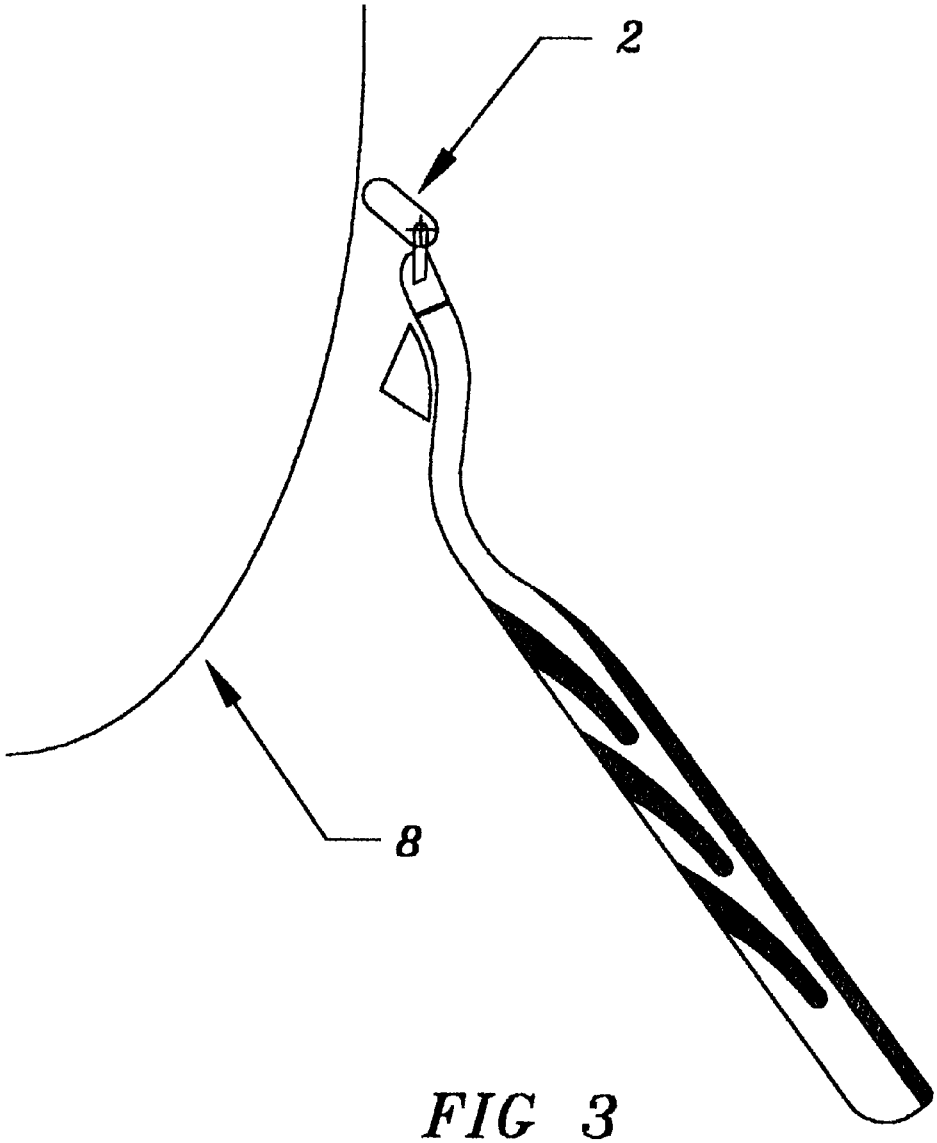
Figure 4:
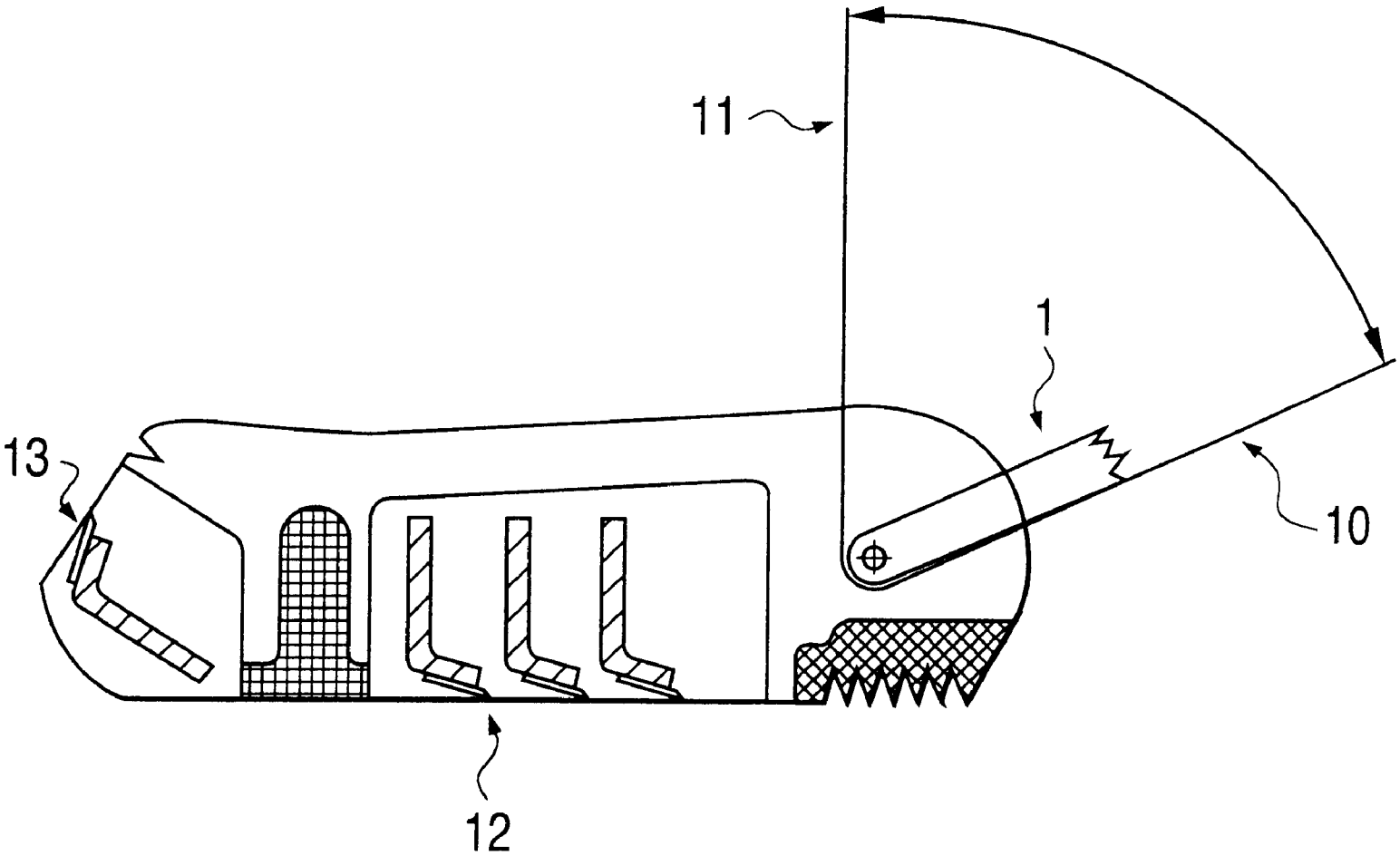

FIG. 2*a* shows the head as indicated in FIG. 2, in which the trim blade is distanced from the skin;

FIG. 3 shows a shaving apparatus according to the present invention schematically appplied to the skin for trimming;

FIG. 3*a* shows the head as indecated in FIG. 3 in which the shaving blades are distanced from the skin; and FIG. 4 illustrated a cross-section through a shaving apparatus with a small portion of the handle attached thereto.

DESCRIPTION OF THE PREFERRED EMBODIMENT

The shaving apparatus shown in the FIGS. comprises handle 1 on which is mounted head body 2. In said head body 2 are located shaving blades 3 and trim blade 4. (There are also located lubricating strip 5 and hair lifter 6 which are not essential parts of the shaving apparatus). Moreover, there is indicated pivoting action centerline 7, the pivoting is eliminated since the handle rests on the rest position stop when the trimming operation is performed.

Referring to FIG. 4, the pivoting angle from a rest position stop 10 to a limit position stop 11 is illustratedd. Furthermore, the pressure direction during regular shaving 12 and trimming 13 has been included.

What is claimed is:

1. A multi-blade shaving apparatus comprising:

a handle;

a head body pivotably supported by said handle at a pivoting action centerline;

a plurality of shaving blades located in said head body, said plurality of shaving blades extending parallel to each other; and an additional blade located in said head body, said additional blade being located in a plane at an angle of 60–120° to a plane of said plurality of shaving blades, and said additional blade being located at a same side of said head body as the plurality of shaving blades relative to the pivoting action centerline.

2. The multi-blade shaving apparatus according to claim 1, wherein there are three of said plurality of shaving blades.

3. The multi-blade shaving apparatus according to claim 1, wherein said plurality of shaving blades and said additional blade are identical in shape when secured to the shaving apparatus.

4. The multi-blade shaving apparatus according to claim 1, further comprising means for rotating the shaving apparatus to enable different of said plurality of shaving blades to be in contact with skin of a user dependent upon rotation of said handle.

5. The multi-blade shaving apparatus according to claim 1, said apparatus further comprising a rest position stop for eliminating pivoting of said handle when said additional blade is in use.

6. The multi-blade shaving apparatus according to claim 1, wherein said angle is between 85–95°.

* * * * *